US005435374A

United States Patent [19]

Fishkis et al.

[11] Patent Number: 5,435,374

[45] Date of Patent: Jul. 25, 1995

[54] FIBER REINFORCED ALUMINUM MATRIX COMPOSITE WITH IMPROVED INTERFACIAL BONDING

[75] Inventors: Maya Fishkis; Chanakya Misra, both of Plum Boro; Karl Wefers, Apollo, all of Pa.

[73] Assignee: Aluminum Company of America, Pittsburgh, Pa.

[21] Appl. No.: 141,817

[22] Filed: Oct. 22, 1993

Related U.S. Application Data

[60] Division of Ser. No. 968,473, Oct. 29, 1992, Pat. No. 5,286,560, which is a continuation of Ser. No. 674,120, Mar. 25, 1991, abandoned.

[51] Int. Cl.[6] ..... B22D 19/14

[52] U.S. Cl. ..... 164/97; 164/100; 164/102

[58] Field of Search ..... 164/97, 100, 102

[56] References Cited

U.S. PATENT DOCUMENTS

| | | | |
|---|---|---|---|
| 4,012,204 | 3/1977 | Riewald et al. . | |
| 4,053,011 | 10/1977 | Riewald et al. . | |
| 4,232,091 | 11/1980 | Grimshaw et al. . | |
| 4,376,803 | 3/1983 | Katzman | 428/408 |
| 4,450,207 | 5/1984 | Donomoto et al. . | |
| 4,569,886 | 2/1986 | Divecha et al. | 428/379 |
| 4,687,043 | 8/1987 | Weiss et al. . | |
| 4,777,014 | 10/1988 | Newkirk et al. | 164/97 |
| 5,163,498 | 11/1992 | Kantner et al. | 164/100 |
| 5,236,032 | 8/1993 | Nukami et al. | 164/100 |
| 5,247,986 | 9/1993 | Kantner et al. | 164/100 |

FOREIGN PATENT DOCUMENTS

| | | | |
|---|---|---|---|
| 0340957 | 8/1989 | European Pat. Off. | 164/100 |
| 60-251247 | 12/1985 | Japan | 164/97 |
| 2-101127 | 4/1990 | Japan . | |

*Primary Examiner*—Mark Rosenbaum
*Assistant Examiner*—Jeffrey T. Knapp
*Attorney, Agent, or Firm*—David W. Pearce-Smith

[57] ABSTRACT

A method for wetting and bonding refractory alumina or aluminosilicate fibers or particles with molten aluminum or aluminum alloys by forming a boron oxidized interface between the fiber and the metal is exists. The method comprises the steps of (a) coating alumina fibers with an effective amount of a thermally decomposable precursor of boron oxide; (b) heating the coated fiber sufficiently to form a boron oxide; and (c) forming a composite with aluminum metal or an aluminum alloy. Thermally decomposable precursors of boron oxide include ammonium pentaborate, ammonium diborate and orthoboric acid.

20 Claims, 2 Drawing Sheets

FIBER REINFORCED ALUMINUM MATRIX COMPOSITE WITH IMPROVED INTERFACIAL BONDING

This application is a division of application Ser. No. 07/968,473, filed Oct. 29, 1992. Now U.S. Pat. No. 5,286,560, which in turn is a continuation of U.S. Ser. No. 07,674,120, filed Mar. 25, 1991. (now abandoned).

BACKGROUND OF THE INVENTION

1. Field of the Invention

The present invention relates to aluminum/alumina composite materials and to methods for increasing the wettability of alumina fibers by molten aluminum or an aluminum alloy. More particularly, the present invention relates to improving the bonding at the interfaces between alumina fibers and aluminum metal.

2. Description of the Prior Art

The main difficulty encountered in forming alumina/aluminum metal matrix composites (MMCs) is that molten aluminum and its alloys do not readily wet alumina. The wetting of the fibers by molten metal is critical to the formation of useful MMCs.

The function of the fibers in composites is to increase the strength and the fracture toughness. These two functions impose contradictory requirements on the alumina/aluminum interface. High strength is achieved through good load transfer from the matrix to the fibers and it requires strong bonding at the interface. High fracture toughness is achieved through crack energy dissipation.

In the past, it has been proposed to manufacture composite materials which comprise reinforcing-alumina fibers enclosed in an aluminum metal matrix by impregnating a suitable assembly of fibers with the molten metal. Alumina fibers do not exhibit strong reactivity with aluminum alloys and therefore they can be used as a compatible reinforcement material. In addition, alumina is very refractory (melting temperature is 1999°C.–2032°C.) and are capable of withstanding processing temperatures of molten aluminum.

It is desired that the alumina fibers be impregnated with the molten aluminum metal either through capillary action in which the fibers are partially or wholly immersed in the molten metal which can be aided by vacuum action in which the fibers are enclosed in an evacuated chamber and the molten metal is admitted into the chamber.

Incomplete wetting of the alumina fibers and the aluminum metal matrix creates voids within the resultant composite material which, in turn, weakens the composite. Then too, even if acceptable wetting is achieved, sufficient bond strength at the interface between the fiber and the metals is desired to obtain high strength. Additional difficulties may be encountered during subsequent welding or brazing of the composite materials. Localized melting of the metal matrix composite during welding or brazing operations may cause a corresponding localized de-wetting of the reinforcing fiber. This, in turn, leads to porosity in the region of the weld or braze. Generally speaking, ineffective wetting and/or ineffective bonding at the interface between the composite layers will degrade the composite's properties.

Additionally, the impregnation of the fibers with the molten metal can take a long time, thereby possibly causing deleterious interaction between the fibers and the metal.

Various prior art attempts to address these problems are known. However, the prior art methods each suffer from one or more serious drawbacks making such methods less than entirely suitable for their intended purposes.

For example, pressure infiltration or squeeze-casting, forcing the molten aluminum into the fibers by employing high pressure, is a common prior art technique. Grimshaw et al U.S. Pat. No. 4,232,091, issued Nov. 4, 1980, describes applying at least 75 kilograms per square centimeter to overcome the surface tension between alumina fibers and molten aluminum or alloys of aluminum, thereby hoping to assure penetration. Donomoto et al U.S. Pat. No. 4,450,207, issued May 22, 1984, found, furthermore, that pressurization at approximately 1,000 kilograms per square centimeter was required in order to infiltrate molten aluminum matrix metals (even having from 0.5 to 4.5 weight percent magnesium for optimum bonding characteristics) into interstices of the reinforcing alumina fibers. In practice, these processes have tended to cause channeling in the mold and thereby do not often assure optimum contact between a metal and the fibers.

Additionally, lithium doping of aluminum and aluminum alloys has been proposed to increase the wetting of the alloy on the alumina fibers. A reaction occurs between the lithium and the alloy at the surface of the fibers which surface becomes gray to black due to the formation of lithium aluminate. For example, Riewald et al U.S. Pat. Nos. 4,012,204 and 4,053,011, issued Mar. 15, 1977, and Oct. 11, 1977, respectively describe composite materials comprising an aluminum-lithium matrix, reinforced with polycrystalline alumina fibers. In order to retain useful strength in the fibers, not more than 15% of the total diameter of the fiber should react with the lithium. Accordingly, the reaction conditions must be carefully controlled insofar as initial lithium content, temperature, and particularly pressure are concerned. In fact, a pressure differential of about 2 to 14 pounds per square inch was needed to overcome the molten metal's resistance to penetration into the alumina fibers.

As previously mentioned, substantial oxidation at the interface between alumina fiber and aluminum metal has been found to be detrimental. Recently, such a problem associated with the presence of oxides at the surface of an aluminum metal layer was addressed by Weiss et al U.S. Pat. No. 4,687,043, issued Aug. 18, 1987. Therein a zinc solder alloy was used interfacially to protect an alumina fiber surface at the interface between aluminum layers to be cast thereon.

Accordingly, it is a principal objective of the present invention to provide a method for improved bonding of aluminum metal or alloys to refractory fibers wherein the fibers are "wet" by the aluminum or aluminum alloy.

Another object of the invention is to provide an alumina fiber reinforced aluminum alloy system which exhibits good interfacial wetting that does not require a low partial pressure of oxygen during fabrication.

A further objective of the present invention is to provide a method that does not require an excessive pressure differential to force fiber impregnation of molten metal.

Yet another object of the invention is to provide an alumina fiber reinforced aluminum alloy system which exhibits good interfacial wetting without the need to use reactive metals such as lithium as a wetting agent.

Yet another object of the present invention is to improve the strength of an alumina fiber/aluminum alloy MMC by increasing bond strength at the interface.

These and other objects and advantages of the present invention will be more fully understood and appreciated with reference to the following description.

SUMMARY OF THE INVENTION

In accordance with the present invention, an improved process for bonding alumina fibers and aluminum metal or alloy and effective wetting of the fibers by the metal is unexpectedly accomplished by forming a mixed boron-aluminum oxides (i.e., intermixture or reaction products of boron oxides and aluminum oxide) at the interface between the fibers and the metal or alloy.

The method of the present invention includes forming an alumina fiber .reinforced aluminum alloys. This includes the steps of (a) coating alumina fibers with a thermally decomposable precursor of boron oxide; (b) heating the coated fiber sufficiently to form a boron-containing oxide; and (c) forming a composite with aluminum metal or an aluminum alloy. Thermally decomposable precursors of boron oxide include ammonium pentaborate, ammonium biborate and orthoboric acid. The most preferred precursor is ammonium pentaborate.

Another aspect of the invention is an alumina fiber reinforced aluminum matrix composite which exhibits improved bond strength and no appreciable de-wetting of the metal and the fibers in subsequent joining. The alumina fiber reinforced aluminum matrix composite comprises: (a) alumina fibers; (b) matrix of aluminum or aluminum alloy metal; and (c) an interlayer of boron-aluminum oxides at the interface between the alumina and the matrix. The composite material exhibits improved bond strength at the above-described interface and no appreciable de-wetting in subsequent brazing or welding.

BRIEF DESCRIPTION OF THE DRAWINGS

Other features and advantages of the present invention will be further described or rendered obvious in the following related description of the preferred embodiment of the present invention which is to be considered together with the accompanying drawings wherein like figures refer to like parts and further wherein.

DETAILED DESCRIPTION OF THE PREFERRED EMBODIMENTS

Figure 1:
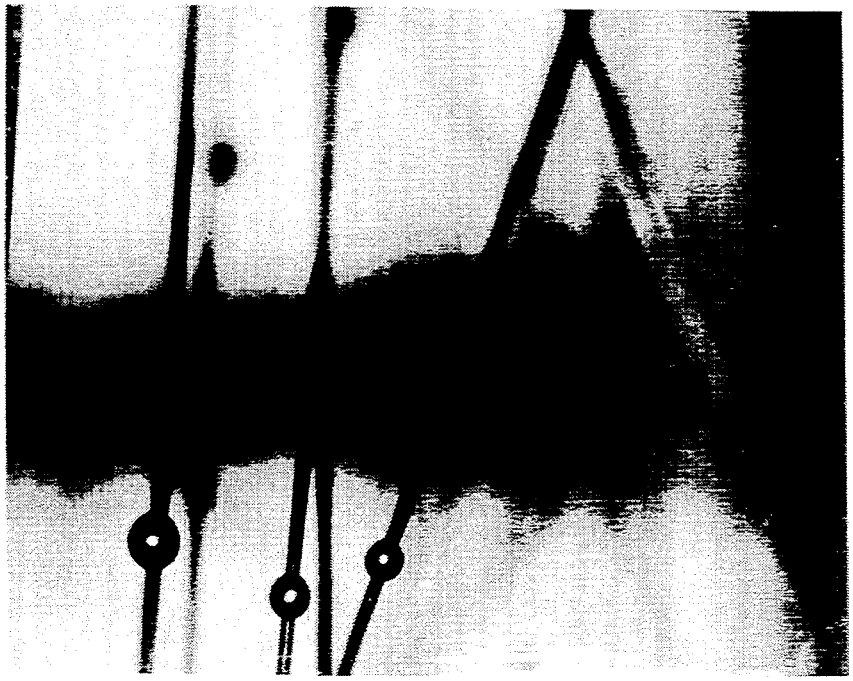
FIG. 1 is a photomicrograph of untreated alumina fibers, vapor coated with 2.5 microns of aluminum and heated above the melting point of aluminum at 100× magnification.

In the process and the product of the present invention, the term "boron-alumina oxide interface" may be generally described as a mixture and reaction products of boron and aluminum oxides at the interface between aluminum metal or alloy and alumina fibers.

The term "effective amount of boron" is used herein to describe the amount of boron reacted at the interface of the alumina fiber and the aluminum alloy so as to permit the desired wetting and improved bond strength of this invention.

The term "aluminum alloy" is used herein to describe aluminum alloys having aluminum metal as a primary constituent.

The term "liquid-phase metal" is used herein to describe all fluid and semi-fluid phases in which the metal is not completely solidified.

Good wetting of fibers by liquid aluminum is a prerequisite for strong bonding at the interfaces. Liquid aluminum does not wet alumina fibers under normal processing conditions. In the processing of alumina/aluminum ($Al_2O_3/Al$) composite materials, high pressure is usually applied to force impregnation of the metal into a fiber preform. However, even high pressure does not assure optimum contact between the aluminum matrix and the alumina fibers.

It has been found that if alumina fibers are coated with boron oxide that subsequent processing to create an alumina fiber/aluminum matrix composite material yields an MMC with increased interfacial wetting. Suitable boron amounts may be provided by way of 1.) immersion of the fibers into saturated solutions of boron oxide precursors and then heating the coated fibers to form boron oxide on the surface, or 2.) vapor deposition of boron onto the surface of the fibers in a layer having thicknesses of, for example, 300Å to 3 microns, or 3.) doping aluminum or aluminum alloy with boron in the amount above its solubility limit prior to coating the fibers with such alloy.

The amount of boron deposited on the surface is important in practicing the present invention. Excessive boron amounts can leave unreacted $B_2O_3$ on alumina surface. This would weaken the interfaces due to melting of $B_2O_3$. Too little boron will, of course, be insufficient to provide the desired wetting.

As taught by Rocher et al U.S. Pat. No. 4,659,593, issued Apr. 21, 1987, even those carbon fibers, so treated, cannot be spontaneously wet by liquid aluminum "if placed in contact with air between the pretreatment and the impregnation" (See Column 3, lines 17–21).

As taught by Novak et al U.S. Pat. No. 4,630,665, boron fibers such as boron nitride are traditionally thought to be "non-wetting" with respect to aluminum metal, unless substantial oxidation is prevented at the interface. On the other hand, the present invention permits interfacial oxidation to be beneficial.

As previously described, the process of the present invention may be practiced by boron oxidized interface formed by any one of several means. Boron oxide ($B_2O_3$) may be formed in situ by immersing alumina fibers in heated, saturated solutions of any thermally decomposable precursor of boron oxide or boron oxide itself. These precursors may be, for example, ammonium pentaborate, ammonium biborate, orthoboric acid, etc. Preferably, ammonium pentaborate is employed.

After immersion, the coated fibers are dried at ambient temperature, for example 75° F., and thereafter heated substantially at temperatures of from 670° C. to 1450° C. but preferably about 1250° C. $B_2O_3$ is known to react with $Al_2O_3$ in the temperature range of 788° C.–1260° C. (1450° F.–2300° F.) to form the compounds $2Al_2O_3.B_2O_3$ and $9Al_2O_3.2B_2O_3$. These compounds are stable up to 1949° C. (3540° F.) and 1035° C. (1895° F.), respectively. These compounds $2Al_2O_3.B_2O_3$ and $9Al_2O_3.2B_2O_3$ are sometimes referred to herein as "mixed aluminum-baron oxides".

It should be noted that a heated solution of ammonium pentaborate into which the fibers were immersed may be heated at, for example, temperatures of between about 50° C. and 90° C., preferably about 75° C., and for a time period needed in order to provide wetting of the fiber surfaces by the solution. Such time ranges from between 10 seconds and 15 minutes but preferably about 1 minute is suitable.

Alternatively, boron oxide itself may be deposited on the surface of the alumina fibers. If this process is employed the coated fibers would still need to be heated substantially at temperatures of from about 670° C. to 1450° C. so that $2Al_2O_3.B_2O_3$ and $9Al_2O_3.2B_2O_3$ can be formed on the surface of the fibers prior to infiltration with the molten aluminum alloy.

A third embodiment of the present invention is to use as a matrix aluminum alloys doped with about 1 percent by weight boron, which is above the solubility limit. Boron would then migrate to the surface of the fibers, oxidize and react with $Al_2O_3$ to form $2Al_2O_3$ and $9Al_2O_3$ on the surface and thus promote wetting and bonding of the molten metal with the alumina fibers. Other alloys containing the ranges of other constituents in addition to the boron may include any wrought or cast aluminum alloy.

The fibers used in the present invention may be amorphous, single crystalline form of alumina or aluminum silicate or a polycrystalline form of aluminum. Aluminosilicates which may be employed include cordierite ($4(Mg, Fe)O.4Al_2O_3.110SiO_2$) and mullite $3Al_2O_3.2SiO_2$. In addition, other fibers which do not contain silica may also be employed in practicing the present invention provided they contain at least 30 wt. % $Al_2O_3$ on their surface.

Surface treatments of this invention can be applied to the surfaces of various alumina or aluminosilicate reinforcements which can be consolidated with aluminum-based alloys to form composite materials. The above-mentioned reinforcements may be particulates of any shape, alumina whiskers, continuous fibers, woven, chopped fibers and preforms of any shape. If particles are to be used as the reinforcement material, it is recommended that the solution of a boron oxide precursor be agitated or stirred to insure good wetting of the solution of the particle surfaces.

The fibers may be consolidated with aluminum-based alloys by any of the known consolidation techniques to form composite materials. These methods include liquid phase infiltration, squeeze casting, rheocasting, compocasting or casting under vacuum without the use of positive pressure. The casting may be carried out using mechanical, hydraulic, vacuum and/or high pressure means.

The surface treatments of this invention provide higher bond strength between the reinforcements and the aluminum alloy and thereby improve mechanical properties, including tensile strength, of the produced composite materials.

The novel composite materials of the present invention contain fibers of refractory alumina or aluminosilicate, a matrix of aluminum metal or alloy material and an interlayer of mixed aluminum-boron oxides at the interface between the fibers and the matrix. These materials exhibit substantially improved bond strength and exhibit no appreciable de-wetting, even upon subsequent welding or brazing.

The following examples illustrate more clearly the manner in which mixed boron-aluminum oxide interfaces of the present invention are formed. The invention, however, should not be construed as being limited to the particular embodiments set forth in the examples.

EXAMPLE 1

FP-alumina fibers, which are commercially available from DuPont, are vapor deposited with a 2.5 micron thick layer of pure aluminum. The aluminum deposition was conducted by physical vapor deposition. The fibers were then heated above the melting point of aluminum or at 750° C. for 15 minutes to provide melting of aluminum and allowed to cool.

FIG. 1 shows the strong de-wetting of aluminum metal on the alumina fibers at 100× magnification. This phenomenon is evidenced by substantially all of the aluminum metal being segregated into droplets on the surface of the fibers. No appreciable spreading or bonding to the fibers of the aluminum metal on the fibers is observed.

EXAMPLE 2

The procedure of Example is repeated except that prior to coating the fibers with aluminum they are treated by immersion in a saturated aqueous solution of ammonium pentaborate at 75° C. for 10 minutes, dried in ambient atmosphere, and subsequently heated in air at 1250° C. for 1 hour.

Figure 2:
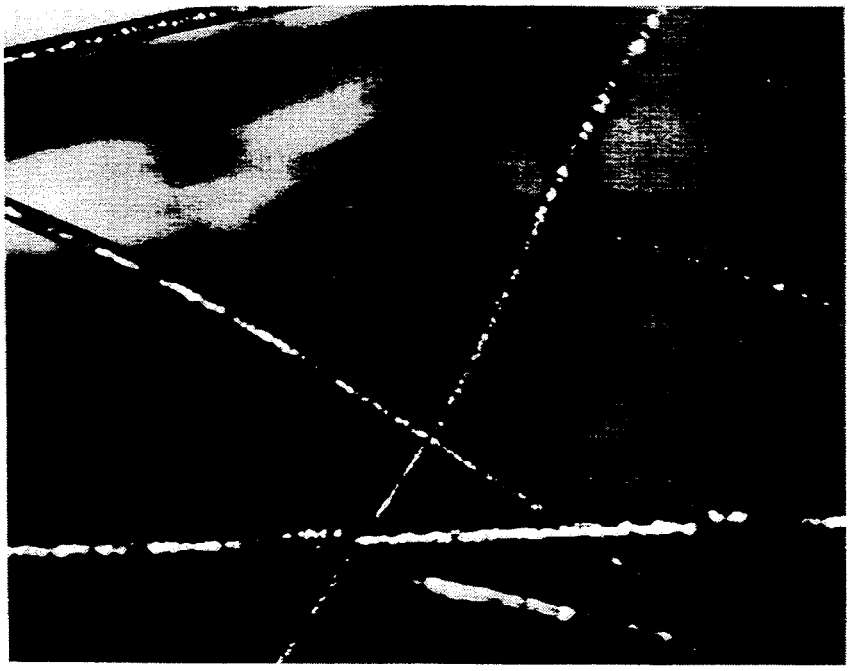
FIG. 2 is a photomicrograph of alumina fibers treated with ammonium pentaborate, vapor coated with 2.5 microns of aluminum and heated above the melting point of aluminum at 100× magnification.
Figure 3:
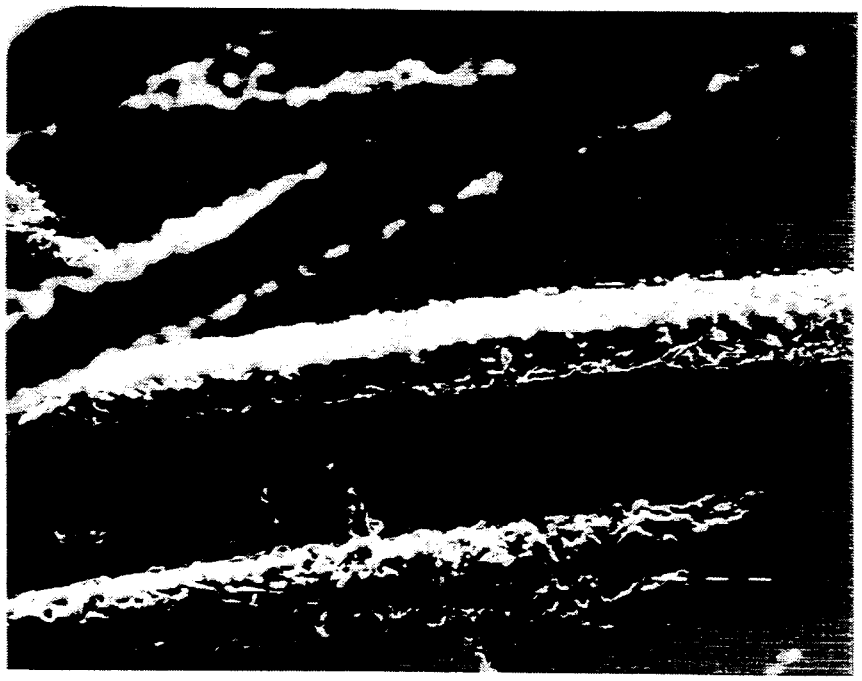
FIG. 3 is an SEM of alumina fibers treated with ammonium pentaborate, vapor coated with 2.5 microns of aluminum and heated above the melting point of aluminum at 500× magnification.

FIG. 2 shows the ammonium pentaborate treated fibers at 100× magnification. The treated fibers exhibited thermal decomposition of the pentaborate into boron oxide forming an interoxidized layer of mixed oxides of $B_2O_3$ and $Al_2O_3$, including $2Al_2O_3.B_2O_3$ and $9Al_2O_3.2B_2O_3$, at the interface between the fibers and the aluminum metal. FIG. 3 is a SEM of alumina fibers treated with ammonium pentaborate, vapor coated with 2.5 microns of aluminum and heated above the melting point of aluminum at 500× magnification. FIGS. 2 and 3 illustrate how the surface treatment increases the wetting of alumina fibers by the molten metal. The aluminum metal wetted the fibers with a substantially even homogeneous metal coating and produced very few aluminum droplets on the surface of the fibers.

EXAMPLE 3

Two refractory alumina rods, 0.5 inch in diameter, are used to evaluate interfacial bonding. The first is untreated and the second rod is treated with a saturated ammonium pentaborate solution by immersing the rod therein at 75° C. for 10 minutes, drying the rod at ambient conditions, and subsequently heating the treated rod at 1250° C. for 1 hour.

An aluminum matrix alloy of Al-4.5Cu-3Mg was melted in a vacuum induction furnace. The alumina rods are immersed in the liquid-phase aluminum alloy and left therein until the surrounding alloy has undergone complete solidification. The integrity and, strength of the interfaces were subsequently evaluated.

Load versus deflection data are collected with an Instron Testing Machine at a cross head rate of 0.05 inches per minute. Examination and mechanical testing of the specimens are reported below in Table I. Low bonding occurred between the untreated alumina rod and the matrix alloy. However, the treated rod demonstrated strong bonding at the interface between the alumina and the matrix. Surprisingly, the treated rod produced an interface that 3 hat was ten (10) fold stronger than the bond between the untreated rod and the matrix. The formation of mixed oxides permitted effective wetting of the alloy to form a strong bond between it and the alumina.

TABLE I

| Specimen | Bond Strength (measured in Mpa) |
|---|---|
| treated alumina rod and matrix | 7.98 |
| untreated alumina rod and matrix | .72 |

EXAMPLE 4

A 400Å thick boron coating was vapor deposited onto FP-alumina fiber surfaces. The boron-coated fibers and untreated fibers were each vapor coated with a 2.5 micron thick layer of pure aluminum by physical vapor deposition and heated until the aluminum melted.

Figure 4:
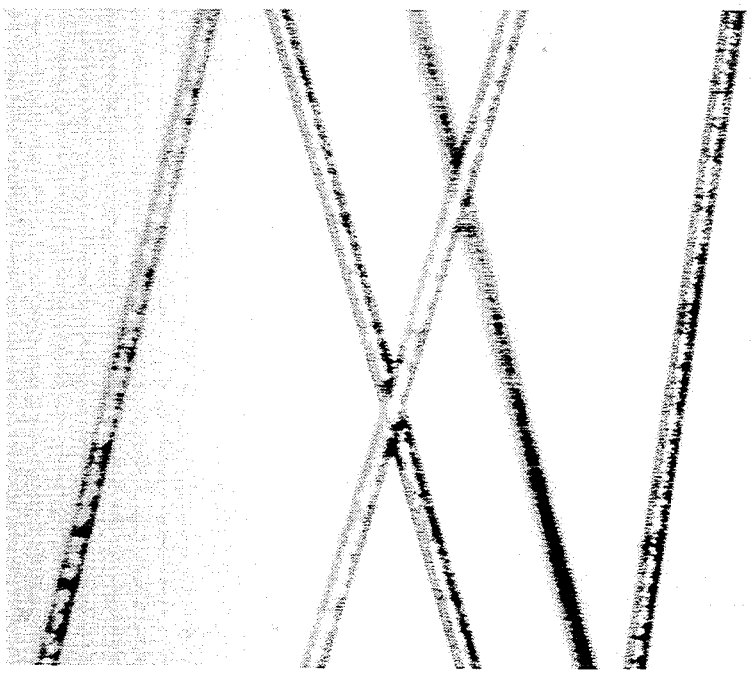
FIG. 4 is a photomicrograph of alumina fibers coated with boron oxide and then vapor coated with 2.5 microns of aluminum and heated above the melting point of aluminum at 100× magnification.

FIG. 4 shows that mixed boron-aluminum oxide of the fiber/metal interface permitted substantial and effective aluminum wetting as compared to that permitted by the untreated fibers which exhibited no appreciable wetting.

EXAMPLE 5

An alumina rod, 0.5 inch in diameter, was introduced into a molten matrix of Al-Cu-Mg-B having about 0.1 percent by weight boron (which is in excess of the solubility limit for boron at the melting point of the matrix). Solidification was permitted. Examination of the consolidated sample showed substantially improved bonding at the interface between the alumina rod and the boron-alloyed aluminum matrix.

Although the present invention has been described in terms of an alumina fiber /aluminum matrix composite, other shapes of alumina may also benefit from the present teachings. Thus for example, equiaxed and non-equiaxed particulate alumina, planar alumina sheets and alumina whiskers, all treated in accordance with the present invention, may be used to reinforce aluminum alloys.

While the invention has been described in terms of preferred embodiments, the claims appended hereto are intended to encompass all embodiments which fall within the spirit of the invention.

What is claimed is:

1. A method for increasing the wetting and bonding of fibers with molten aluminum alloys consisting essentially of aluminum, said fibers containing less than 1 wt. % boron and at least 30 wt. % $Al_2O_3$, said method comprising forming a mixed boron-aluminum oxide interface between said fibers and the aluminum.

2. The method of claim 1 wherein the mixed boron-aluminum oxide interface is formed by alloying said molten aluminum alloy with amount of boron which is greater than the solubility limit of said alloy.

3. The method of claim 1 wherein said boron-aluminum oxide interface is formed by:

(a) coating said alumina-containing fibers with a thermally decomposable precursor of boron oxide selected from the group of ammonium pentaborate, ammonium diborate and orthoboric acid, thereby to form coated fibers;

(b) heating said coated fiber sufficiently to decompose said decomposable precursor into boron oxide; and (c) forming a composite with said coated fibers and aluminum metal or an aluminum alloy.

4. The method of claim 1 wherein the mixed boro-aluminum oxide is formed by:

(a) coating alumina-containing fibers with boron oxide; and (b) forming a composite with aluminum metal or alloy.

5. The method of claim 1 wherein the mixed boron-aluminum oxide is formed by:

(a) coating said alumina-containing fibers with pure boron;

(b) forming a composite with aluminum metal or alloy.

6. The method of claim 1 wherein the mixed boron-aluminum oxide interface is formed by:

(a) forming a molten boron-alloyed aluminum matrix containing an amount of boron which is greater than the solubility limit of said alloy; and (b) forming a composite with aluminum metal or alloy.

7. The method of claim 1 wherein said fibers are selected from the group consisting of alumina, cordierite, mullite, aluminum silicate or polycrystalline aluminum.

8. The method of claim 1 wherein said fibers contain at least 90 wt. % alumina.

9. The method of claim 1 in which said forming step comprises immersing said fibers into an aqueous solution of a boron compound for at least 10 seconds prior to contacting said fibers with said molten aluminum alloy.

10. The method of claim 1 which further includes:

immersing said fibers into an aqueous solution of a boron compound for at least 10 seconds; and then heating said fibers to a temperature between 670°–1450° F. after said immersing step and prior to contacting said fibers with said molten aluminum.

11. The method of claim 1 which said forming step forms a boron-aluminum oxide interface having a thickness of 300 Å to 3 microns.

12. The method of claim 1 wherein the mixed boron-aluminum oxide interface is formed by coating alumina fibers with a material selected from the group consisting of boron, boron oxide, boron oxide precursors, and boron-alloys of aluminum.

13. The method of claim 12 wherein said boron precursors are selected from the group of ammonium pentaborate, ammonium biborate and orthoboric acid.

14. In a method for forming aluminum composites reinforced with reinforcement material containing less than 1 wt. % boron and at least 30 wt. % $Al_2O_3$, the improvement comprising:

immersing said reinforcement material into an aqueous solution of a boron compound for at least 10 seconds; and then heating said reinforcement material to a temperature between 670°–1450° F. after said immersing step and prior to contacting said fibers with molten aluminum, said molten aluminum consisting essentially of aluminum.

15. The method of claim 14 in which said reinforcement material is selected from the group consisting of fibers, particles, whiskers and sheets.

16. The method of claim 14 in which said heating step forms an interlayer of mixed oxides of aluminum and boron includes $B_2O_3$, $Al_2O_3$, $2Al_2O_3B_2O_3$ and $9Al_2O_32B_2O_3$ on said reinforcement material.

17. The method of claim 14 in which said immersing step includes immersing said reinforcement material into an aqueous solution formed from a boron compound selected from the group consisting of boron, boron oxide and ammonium pentaborate, ammonium diborate and orthoboric acid.

18. The method of claim 14 in which said heating step is conducted above 800° F. for at least 1 minute.

19. A method for increasing the wetting and bonding of fibers with molten aluminum alloys consisting essentially of aluminum, said fibers containing less than 1 wt. % boron and at least 30 wt. % $Al_2O_3$, said method comprising:

(a) coating said fibers with ammonium pentaborate;

(b) heating said coated fiber sufficiently to decompose said ammonium pentaborate; and (c) forming a composite with aluminum metal or alloy.

20. A method for increasing the wetting and bonding of fibers containing at least 30 wt. % $Al_2O_3$ with molten aluminum alloys consisting essentially of aluminum, said method comprising forming a mixed boron-aluminum oxide interface between said fibers and the aluminum wherein said mixed boron-aluminum oxide interface is formed by alloying said molten aluminum alloy with an amount of boron which is greater than the solubility limit of said alloy.

* * * * *

UNITED STATES PATENT AND TRADEMARK OFFICE

CERTIFICATE OF CORRECTION

PATENT NO. : 5,435,374

DATED : July 25, 1995

INVENTOR(S) : Maya Fishkis, et. al.

It is certified that error appears in the above-indentified patent and that said Letters Patent is hereby corrected as shown below:

Column 8, Claim 3, line 1, after "wherein" delete "said" and insert therefor --the mixed--.

Signed and Sealed this

Thirtieth Day of January, 1996

*Attest:*

*Attesting Officer*

BRUCE LEHMAN

*Commissioner of Patents and Trademarks*